US009828997B2

(12) United States Patent
Kawano

(10) Patent No.: US 9,828,997 B2
(45) Date of Patent: Nov. 28, 2017

(54) SCROLL COMPRESSOR WITH A RESONATOR

(71) Applicant: DENSO CORPORATION, Kariya, Aichi-pref. (JP)

(72) Inventor: Shigeru Kawano, Chiryu (JP)

(73) Assignee: DENSO CORPORATION, Kariya (JP)

( * ) Notice: Subject to any disclaimer, the term of this patent is extended or adjusted under 35 U.S.C. 154(b) by 252 days.

(21) Appl. No.: 14/762,872

(22) PCT Filed: Dec. 12, 2013

(86) PCT No.: PCT/JP2013/007329
§ 371 (c)(1),
(2) Date: Jul. 23, 2015

(87) PCT Pub. No.: WO2014/118855
PCT Pub. Date: Aug. 7, 2014

(65) Prior Publication Data

US 2015/0361981 A1 Dec. 17, 2015

(30) Foreign Application Priority Data

Jan. 30, 2013 (JP) ..... 2013-16043

(51) Int. Cl.
*F04C 29/00* (2006.01)
*F04C 29/12* (2006.01)
(Continued)

(52) U.S. Cl.
CPC ..... *F04C 29/0035* (2013.01); *F04B 39/0066* (2013.01); *F04C 18/0215* (2013.01);
(Continued)

(58) Field of Classification Search
CPC ..... F04B 39/0066; F04C 29/0035; F04C 29/061; F04C 29/068; F04C 18/0215; F04C 29/0085; F04C 29/026; F04C 29/12
See application file for complete search history.

(56) References Cited

U.S. PATENT DOCUMENTS 6,176,687 B1 * 1/2001 Kim ..... F04B 39/0066 137/855
6,309,197 B1 * 10/2001 Bush ..... F04C 27/005 418/55.4
(Continued)

FOREIGN PATENT DOCUMENTS

JP 2000-161220 A 6/2000
JP 3062815 B1 7/2000
(Continued)

OTHER PUBLICATIONS

International Search Report and Written Opinion of the International Searching Authority dated Jan. 21, 2014 issued in the corresponding International application No. PCT/JP2013/007329 (and English translation).
(Continued)

*Primary Examiner* — Mary A Davis
(74) *Attorney, Agent, or Firm* — Posz Law Group, PLC

(57) ABSTRACT

A discharge chamber, into which refrigerant compressed by a compression mechanism, is discharged, is formed in an inside of a housing. A resonator is connected to an intermediate portion of a communication passage, which communicates between the discharge chamber and a discharge port of the housing. The resonator includes a resonance chamber and an inlet passage. The inlet passage has one end portion, which is connected to the intermediate portion of the communication passage, and another end portion, which is connected to the resonance chamber.

20 Claims, 6 Drawing Sheets

(51) Int. Cl.

| | |
|---|---|
| ***F04C 18/02*** | (2006.01) |
| ***F04C 29/06*** | (2006.01) |
| ***F04C 29/02*** | (2006.01) |
| ***F04B 39/00*** | (2006.01) |

(52) U.S. Cl.
CPC ..... *F04C 29/0085* (2013.01); *F04C 29/026* (2013.01); *F04C 29/061* (2013.01); *F04C 29/068* (2013.01); *F04C 29/12* (2013.01)

(56) References Cited

U.S. PATENT DOCUMENTS

| | | | | |
|---|---|---|---|---|
| 7,156,624 | B2 * | 1/2007 | Shoulders | F04C 29/0035 181/212 |
| 7,993,112 | B2 * | 8/2011 | Rockwell | F04C 29/0035 181/272 |
| 9,255,579 | B2 * | 2/2016 | Mitsuhashi | F04C 29/068 |
| 2011/0027115 | A1 | 2/2011 | Oh et al. | |

FOREIGN PATENT DOCUMENTS

| | | | | |
|---|---|---|---|---|
| JP | 2004-316591 | A | 11/2004 | |
| JP | 2009-074485 | A | 4/2009 | |
| JP | 2009-167983 | A | 7/2009 | |
| WO | WO 2011126032 | A2 * | 10/2011 | F04C 29/068 |
| WO | 2012-157224 | A1 | 11/2012 | |

OTHER PUBLICATIONS

Office Action dated Mar. 1, 2016 in the corresponding JP application No. 2013-016043 (with English translation).

* cited by examiner

SCROLL COMPRESSOR WITH A RESONATOR

CROSS REFERENCE TO RELATED APPLICATION

This application is the U.S. national phase of International Patent Application No. PCT/JP2013/007329 filed on Dec. 12, 2013 and is based on and incorporates herein by reference Japanese Patent Application No. 2013-016043 filed on Jan. 30, 2013.

TECHNICAL FIELD

The present disclosure relates to a compressor that includes a resonator, which reduces pulsation of refrigerant.

BACKGROUND ART

In a compressor, which compresses refrigerant gas, it is known to place an increased volume portion, which serves as a silencer, in a passage located immediately after a discharge valve in order to reduce pulsation of the refrigerant gas. Furthermore, in a case where a frequency of a sound, which needs to be lowered, is obvious due to presence of a resonance frequency of, for example, a valve of a compressor, or a resonance frequency of a vibration of a conduit of a refrigerant cycle or a heat exchanger, it is known to use a Helmholtz resonator, which can provide a pulsation damping effect for the frequency of the sound, which needs to be lowered.

The compressor, which uses the Helmholtz resonator, is recited in the Patent Literatures 1, 2. The Patent Literature 1 discloses a technique of placing the Helmholtz resonator immediately after a location where compression of the refrigerant takes place in a vane compressor. In the compressor of the Patent Literature 1, an oil separator is placed on a downstream side of a discharge passage located on a downstream side of a discharge chamber that is used as a silencer chamber of the Helmholtz resonator.

The Patent Literature 2 discloses a technique of placing a resonance chamber of a Helmholtz resonator at a location, which is closed by a valve plate and an intake valve at a discharge port that discharges refrigerant in a compressor having multiple pistons received in multiple cylinders. Therefore, the resonance chamber of the Helmholtz resonator is placed on an upstream side of a discharge valve and a discharge chamber.

In the apparatuses disclosed in the Patent Literatures 1, 2, the resonator is placed in a location where a sufficient amount of lubricating oil is contained. Therefore, when the lubricating oil flows into a choking passage of the resonator (a narrow passage communicated with the resonance chamber), there may occur phenomenon of, for example, that a passage cross-sectional area of the choking passage is reduced by the lubricating oil, or the lubricating oil is trapped in the resonance chamber. Due to the above phenomenon, the resonator cannot generate a sound of a target resonance frequency in the apparatuses of the Patent Literatures 1, 2. Thus, an actual resonance frequency deviates from a designed resonance frequency, and thereby a sufficient amount of reduction of the pulsation cannot be achieved.

CITATION LIST

Patent Literature

PATENT LITERATURE 1: JP3062815B1
PATENT LITERATURE 2: JP2000-161220A

SUMMARY OF INVENTION

The present disclosure is made in view of the above disadvantages, and it is an objective of the present disclosure to provide a compressor that limits pulsation by limiting a deviation between a designed resonance frequency and an actual resonance frequency.

To achieve the above objective, the present disclosure provides a compressor that includes a housing, a compression mechanism, a discharge chamber, a communication passage and a resonator. The housing includes a suction port, into which refrigerant flows from an outside of the housing, and a discharge port, through which the refrigerant is discharged to the outside of the housing after compression of the refrigerant. The compression mechanism is formed in an inside of the housing and compresses the refrigerant drawn through the suction port. The discharge chamber is formed in the inside of the housing, and the refrigerant, which is compressed by the compression mechanism, is discharged into the discharge chamber immediately after compression of the refrigerant by the compression mechanism. The communication passage communicates between the discharge chamber and the discharge port. The resonator is connected to an intermediate portion of the communication passage. The resonator includes a resonance chamber and an inlet passage. The resonance chamber is communicated with the intermediate portion of the communication passage. The inlet passage has one end portion, which is connected to the intermediate portion of the communication passage, and another end portion, which is connected to the resonance chamber.

DESCRIPTION OF EMBODIMENTS

Figure 1:
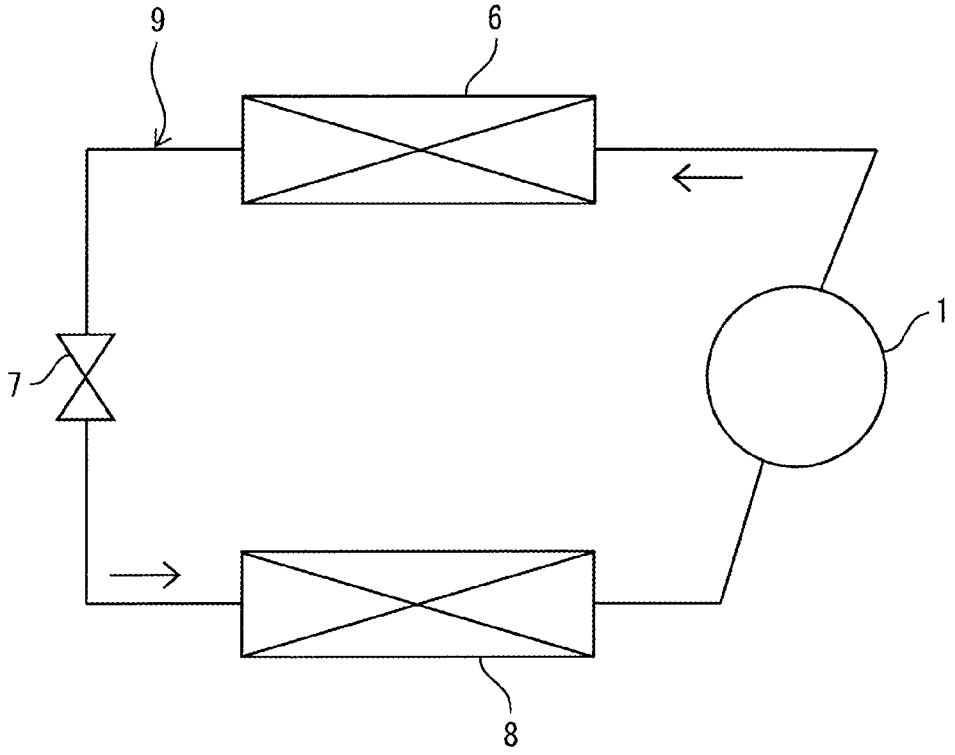
FIG. 1 is a schematic diagram showing a refrigerant cycle having a compressor according to a first embodiment of the present disclosure.

Various embodiments of the present disclosure will be described with reference to the accompanying drawings. In the following respective embodiments, portions, which are described in a previous embodiment(s), will be indicated by the same reference numerals and will not be redundantly described in some cases. In each of the following embodiments, if only a part of a structure is described, the remaining part of the structure is the same as that of the previously described embodiment(s). Besides a combination(s) of the portions, which are explicitly described in the following respective embodiments, any other combination(s) of the components of the following embodiments, which is not explicitly described below, may be made as long as there is no problem with respect to such a combination.

First Embodiment

A compressor 1 of a first embodiment of the present disclosure is used in a refrigerant cycle, in which refrigerant is circulated. The compressor 1 can be applied to, for example, a vehicle air conditioning apparatus, or a hot-water supply apparatus, which heats water. The compressor 1 includes a resonance silencer (a resonator), in which a resonance frequency of a resonance chamber is set to a specific frequency, so that pressure pulsation, which has a frequency that is the same as or close to the specific frequency, can be effectively damped.

The first embodiment will be described with reference to FIGS. 1 to 5. A refrigeration cycle 9 of the present embodiment includes the compressor 1, which draws and compresses the refrigerant, a radiator 6, which releases a heat from the refrigerant outputted from the compressor 1, a decompression device 7, which decompresses the refrigerant outputted from the radiator 6, and an evaporator 8, which absorbs heat from outside air to evaporate the refrigerant (see FIG. 1).

In a case where the compressor 1 is used in the vehicle air conditioning apparatus, the radiator 6 is an outdoor heat exchanger, and the evaporator 8 is an air cooling heat exchanger placed in a passage of an air conditioning unit. In a case where the compressor 1 is used in a hot-water supply apparatus of a heat pump type, the radiator 6 is a water-refrigerant heat exchanger, which exchanges a heat between the hot water of a hot water storage tank and the refrigerant outputted from the compressor 1, and the refrigeration cycle 9 forms a heat pump unit.

The compressor 1 is a compressor of a horizontal type, which uses HFC-134a (also referred to as 1,1,1,2-Tetrafluoroethane) as the refrigerant and drives a compression mechanism 4 by an electric motor unit (hereinafter referred to as a motor unit) 3 of a horizontal type installed in an inside of the compressor 1. A housing 100 of the compressor 1 includes a first housing 13, a second housing 50, which receives an inverter 2, and a third housing 29, which is located on the compression mechanism 4 side. A suction port 14, into which the refrigerant from the outside (the evaporator 8) is supplied, and a discharge port 27, from which the refrigerant after compression of the refrigerant is discharged to the outside (the radiator 6), are formed in the housing 100 of the compressor 1. The suction port 14 is formed in the first housing 13. Furthermore, a pipe, which is communicated with the evaporator 8 and forms a portion of an external circuit, is connected to the suction port 14. The discharge port 27 is formed in the third housing 29. A pipe, which is communicated with the radiator 6 and forms a portion of the external circuit, is connected to the discharge port 27.

The motor unit 3 and the compression mechanism 4 are placed in an inside of the first housing 13.

The first housing 13 also serves as a motor housing that receives the motor unit 3. The second housing 50 and the third housing 29 are connected to the first housing 13 in such a manner that the second housing 50 and the third housing 29 clamp the first housing 13 therebetween. The second housing 50, the first housing 13, and the third housing 29 are arranged one after another in this order from the left side to the right side in FIG. 2. The housing 100 of the compressor 1 forms a closed container that is formed by welding the second housing 50 and the third housing 29 to the first housing 13.

The inverter 2, which drives the motor unit 3, is placed in an inside of the second housing 50, and thereby the refrigerant does not flow in the inside of the second housing 50. A flow range of the refrigerant includes an inside of the first housing 13 and an inside of the third housing 29. A seal member, which limits leakage of the refrigerant, is formed in a predetermined location in a connecting portion between the first housing 13 and the third housing 29. The seal member is, for example, an O-ring or a packing member of a planar ring form made of elastomer.

The motor unit 3 includes a rotor 11, which is received in a motor chamber 15 formed in an inside of the first housing 13, a stator 12, which surrounds the rotor 11 in a circumferential direction, and a shaft 10, which is rotated integrally with the rotor 11. Furthermore, the stator 12 is press fitted to and is secured to an inner peripheral surface of the first housing 13 at a location that is on a radially outer side of the rotor 11. The motor chamber 15 is an inside space of the first housing 13, into which the rotor 11 and the stator 12 are placed.

Among a plurality of bearings, which support the shaft 10 in a rotatable manner about a rotational axis O, a bearing 40*a*, which is placed at the inverter 2 side, and a bearing 40*b*, which is covered with a frame 16, are placed in the motor chamber 15. The frame 16 is placed at the third housing 29 side in the inside of the first housing 13 and fixes the bearing 40*b*, which rotatably supports the shaft 10 at the compression mechanism 4 side.

Figure 2:
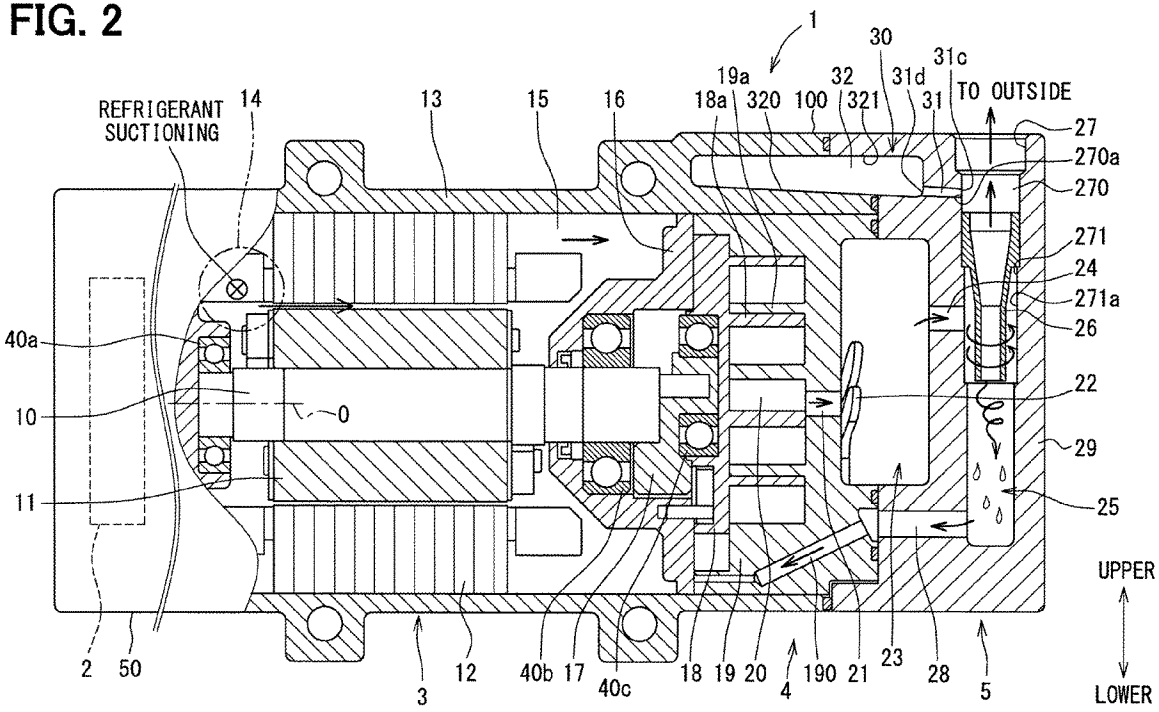
FIG. 2 is a cross-sectional view showing an internal structure of the compressor of the first embodiment.

The suction port 14 is an inlet, into which the refrigerant is supplied from the outside. The suction port 14 is exposed to the motor chamber. As shown in FIG. 2, the refrigerant flows from the suction port 14, which is opened in an inner peripheral surface of the first housing 13, in a direction perpendicular to the shaft 10 and is drawn toward the inverter 2 side of the motor chamber 15. The suction port 14 is located on a front side of a plane of FIG. 2, so that the suction port 14 is indicated by an imaginary line in FIG. 2.

The compression mechanism 4 is a mechanism that draws the refrigerant from the motor chamber 15 and compresses the drawn refrigerant. The compression mechanism 4 is a compression mechanism of a scroll type, which includes a stationary scroll 19 and an orbiting scroll 18 (serving as a movable scroll). The stationary scroll 19 is fixed to the first housing 13 and includes a stationary wrap 19*a*. The orbiting scroll 18 includes a movable wrap 18*a*, which is meshed with the stationary wrap 19*a* to form a compression chamber 20. The stationary scroll 19 is fixed in the first housing 13 at a location, which is opposite from the motor unit 3. The orbiting scroll 18, which serves as a movable member, is placed to mesh with the stationary scroll 19.

An eccentric portion 17 is formed at a distal end portion of the shaft 10, which is located on the orbiting scroll 18 side. The eccentric portion 17 is inserted through a bearing 40*c*, which is placed on a side of the orbiting scroll 18, which is opposite from the stationary scroll 19. Due to an action of a rotation limiting mechanism, the orbiting scroll 18 is revolved relative to the stationary scroll 19 in response to rotation of the shaft 10. The compression chamber 20, which is communicated with the motor chamber 15 toward a center side, is formed between the orbiting scroll 18 and the stationary scroll 19.

A stationary scroll internal passage 190 extends through a lower portion of the stationary scroll 19. The stationary scroll internal passage 190 is a passage that supplies lubricating oil, which is contained in the refrigerant accumulated at a lower portion of an oil separator 25, to a slidable portion of the orbiting scroll 18. The stationary scroll internal passage 190 is formed on a lower side of an outer peripheral portion of the orbiting scroll 18. In other words, a lowest portion of the stationary scroll internal passage 190 is located on a lower side of the outer peripheral portion of the orbiting scroll 18.

The discharge port 21 is formed in the stationary scroll 19, and the refrigerant, which is drawn from the motor chamber 15 into the compression chamber 20 and is compressed in the compression chamber 20, is discharged through the discharge port 21. A discharge chamber 23 is formed on a downstream side of the discharge port 21 immediately after the discharge port 21 in the flow direction of the refrigerant. The discharge port 21 is a through-hole that is formed in a center portion of the stationary scroll 19. The discharge chamber 23 is a space, to which an outlet of the discharge port 21 is opened, and the discharge chamber 23 includes a discharge valve 22. In other words, the discharge chamber 23 is a chamber, into which the refrigerant immediately after compression thereof at the compression mechanism 4 is discharged. The discharge valve 22 is a check valve that limits backflow of the high pressure refrigerant, which is discharged into the discharge chamber 23, into the compression chamber 20 through the discharge port 21.

An oil separating portion 5 is formed in a refrigerant passage that conducts the refrigerant compressed by the compression mechanism 4 from the discharge chamber 23 to the discharge port 27. The oil separator 25, which serves as an oil separating means, is formed in the oil separating portion 5. That is, the oil separator 25 is formed in an intermediate portion of a communication passage 270 that communicates between the discharge chamber 23 and the discharge port 27. The oil separator 25 is an oil separator of a centrifugal separation type (a lubricating oil separating means of a centrifugal separation type), which separates the lubricating oil contained in the refrigerant at the outlet side of the compression mechanism 4. The oil separator 25 includes an inlet passage 24, a separating pipe 26, and an outlet passage 28.

The separating pipe 26 is a conduit, which is configured into a generally cylindrical tubular form and has a downstream end portion communicated with the discharge port 27 through the communication passage 270. The separating pipe 26 is placed in an inside of a separating chamber 271, which forms a cylindrical space that is concentric with the separating pipe 26. The inlet passage 24, which is communicated with the discharge chamber 23, opens in a cylindrical wall surface 271*a* of the separating chamber 271, in which the separating pipe 26 is placed. Furthermore, it is desirable that a flow direction of the refrigerant, which enters the separating chamber 271 from the inlet passage 24, is generally parallel to a tangential direction that is tangential to a circle of a cross section of an adjacent portion of the cylindrical wall surface 271*a* of the separating chamber 271, which is adjacent to the opening of the inlet passage 24.

The refrigerant, which is compressed by the compression mechanism 4, flows from the discharge chamber 23 into the separating chamber 271 through the inlet passage 24 and flows downward while swirling between the cylindrical wall surface 271*a* and an outer peripheral surface of the separating pipe 26 in the separating chamber 271. At this time, the lubricating oil contained in the refrigerant falls below a lower end opening of the separating pipe 26 after being separated from the refrigerant gas and flows into the outlet passage 28 through an opening, which is formed in a bottom surface portion of the separating chamber 271. The lubricating oil, which is outputted to the outlet passage 28, flows into the stationary scroll internal passage 190 connected to the outlet passage 28 and reaches to the slidable portion of the orbiting scroll 18. Furthermore, the refrigerant gas, from which the lubricating oil is separated by the oil separator 25, is discharged from the discharge port 27 to the outside of the compressor 1 as high pressure refrigerant through the communication passage 270.

The resonator 30 is connected to a connecting portion 270*a*, which is an intermediate portion of the communication passage 270 that communicates between the discharge chamber 23 and the discharge port 27. The communication passage 270 is defined as a passage that communicates between the discharge chamber 23 and the discharge port 27. Therefore, the inlet passage 24 and the separating chamber 271 form a part of the communication passage 270, and the oil separator 25 is placed in the middle of the communication passage 270. It is preferred that the resonator 30 is connected to the intermediate portion of the communication passage 270, which is located on a downstream side of the oil separator 25, and the resonator 30 may possibly be connected to the communication passage 270 at a location that is other than the connecting portion 270*a* shown in FIG. 2.

The resonator 30 includes a resonance chamber 32 and an inlet passage 31. The resonance chamber 32 is placed on a radially outer side of the orbiting scroll 18 and the stationary scroll 19. One end portion 31*c* of the inlet passage 31 is connected to the connecting portion 270*a* of the communication passage 270, and the other end portion 31*d* of the inlet passage 31 is connected to the resonance chamber 32. Specifically, the resonance chamber 32 is communicated with the connecting portion 270*a* of the communication passage 270 through the inlet passage 31. A cross-sectional area (a passage cross-sectional area) of the inlet passage 31 is smaller than a cross-sectional area of the resonance chamber 32, which is measured in a direction perpendicular to a longitudinal direction of the resonance chamber 32, and the cross-sectional area of the inlet passage 31 is smaller than a cross-sectional area (a passage cross-sectional area) of an adjacent portion of the communication passage 270, which is adjacent to the inlet passage 31. The cross-sectional area (the passage cross-sectional area) of the inlet passage 31 is smaller than the cross-sectional area of the resonance chamber 32, which measured in the longitudinal direction of the resonance chamber 32.

The resonance chamber 32 is configured such that the cross-sectional area of the resonance chamber 32 is larger than the cross-sectional area of the inlet passage 31, and a volume of the resonance chamber 32 is larger than a volume of the inlet passage 31. The resonance chamber 32 is an empty space that opens only to the inlet passage 31, and the resonance chamber 32 is tapered in a direction (the left side in FIG. 2) that is away from the other end portion 31*d* of the inlet passage 31. A portion of the refrigerant gas, which flows to the discharge port 27 through the communication passage 270, is filled in the resonance chamber 32 through the inlet passage 31.

Figure 3:
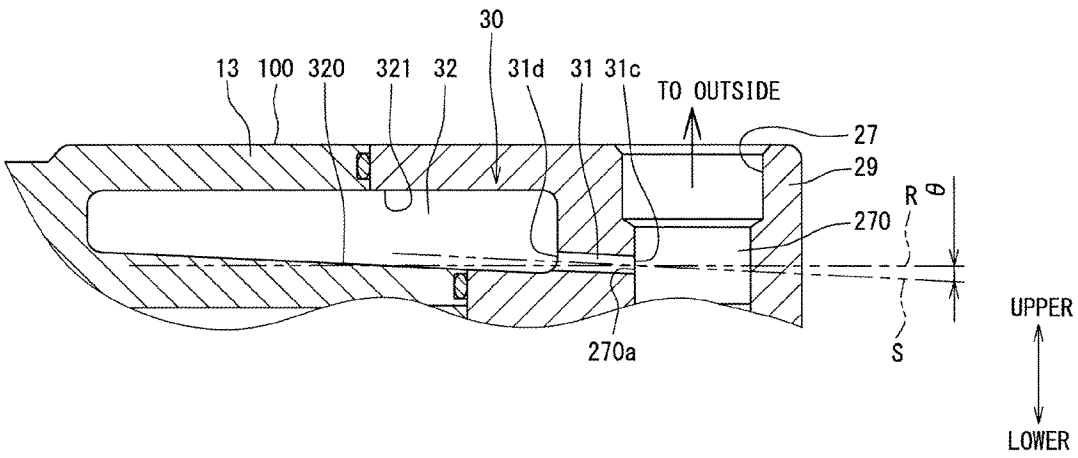
FIG. 3 is a partial enlarged cross sectional view of a resonator of the first embodiment.

The inlet passage 31 is connected to the communication passage 270 such that an axis of the inlet passage 31 crosses an axis of the communication passage 270. In the first embodiment, since the communication passage 270 extends in a top-to-bottom direction or a vertical direction, a resonance chamber 32 side of the inlet passage 31 is placed above a communication passage 270 side of the inlet passage 31. That is, the other end portion 31*d* of the inlet passage 31, which is connected to the resonance chamber 32, is placed above the one end portion 31*c* of the inlet passage 31, which is connected to the connecting portion 270*a* of the communication passage 270. In other words, the other end portion 31*d* of the inlet passage 31 is further spaced from the rotational axis O of the shaft 10 in the radial direction of the shaft 10 in comparison to the one end portion 31*c* of the inlet passage 31. For example, as shown in FIG. 3, an axis S of the inlet passage 31 is set such that a resonance chamber 32 side of the axis S of the inlet passage 31 is placed at a location that is higher than the other side of the axis S of the inlet passage 31 to define a predetermined angle relative to a reference line R that extends in the horizontal direction. In this way, the fluid, which is supplied into the inlet passage 31, tends to flow from the resonance chamber 32 side to the communication passage 270 side by the gravitational force and does not tend to stay in the inlet passage 31. In the present embodiment, the reference line R is an axis that is generally parallel to the rotational axis O of the shaft 10.

The resonance chamber 32 has a bottom surface 320 that is located on a lower side (a rotational axis O side in the radial direction) in the vertical direction. The bottom surface 320 is formed such that the bottom surface 320 is lowered toward the other end portion 31*d* of the inlet passage 31. Specifically, the bottom surface 320 of the resonance chamber 32 is declined toward the other end portion 31*d* of the inlet passage 31. In other words, a distance between the bottom surface 320 of the resonance chamber 32 and the rotational axis O of the shaft 10 is decreased toward the other end portion 31*d* of the inlet passage 31 in the axial direction of the rotational axis O. The resonance chamber 32 further includes a ceiling surface 321, which is located on an opposite side that is opposite from the bottom surface 320 in the radial direction. At an end portion of the resonance chamber 32, which is adjacent to the other end portion 31*d* of the inlet passage 31, a radial distance between the bottom surface 320 of the resonance chamber 32 and the other end portion 31*d* of the inlet passage 31 is smaller than a radial distance between the ceiling surface 321 of the resonance chamber 32 and the other end portion 31*d* of the inlet passage 31. Here, the radial distance between the bottom surface 320 of the resonance chamber 32 and the other end portion 31*d* of the inlet passage 31 may be substantially zero or may be larger than zero. For example, similar to the inlet passage 31, the bottom surface 320 of the resonance chamber 32 is formed such that the inlet passage 31 side is lowered to define the angle θ relative to the reference line that extends in the horizontal direction. In this way, due to the gravitational force, the fluid (e.g., the lubricating oil), which flows into the resonance chamber 32, is outputted from the resonance chamber 32 into the inlet passage 31 and is then outputted into the communication passage 270 after flowing through the tilted inlet passage 31.

The resonator 30 is formed in the inside of the housing 100 of the compressor 1. Specifically, the resonance chamber 32 is a chamber that is formed by combining the first housing 13 and the third housing 29. The inlet passage 31 is a passage that is formed in an inside of the third housing 29.

The resonance chamber 32 extends over the stationary scroll 19 and the orbiting scroll 18 of the compression mechanism 4 and the discharge chamber 23 at a location that is on the outer side (a lateral side or an upper side) of the stationary scroll 19 and the orbiting scroll 18 of the compression mechanism 4 and the discharge chamber 23. The inlet passage 31 is located on the outer side (the lateral side or the upper side) of the discharge chamber 23. In other words, the resonance chamber 32, the inlet passage 31, or the resonator 30 is placed on the outer side of the oil separating means (the oil separator 25) or is placed at a position that is higher than the oil separating means (the oil separator 25) and is lower than the discharge port 27. With this construction, the effective use of the space, in which the resonator 30 is placed, is achieved, and it is possible to limit an increase in a size of the compressor 1 that has an advantage of reducing the pulsation.

Figure 4:
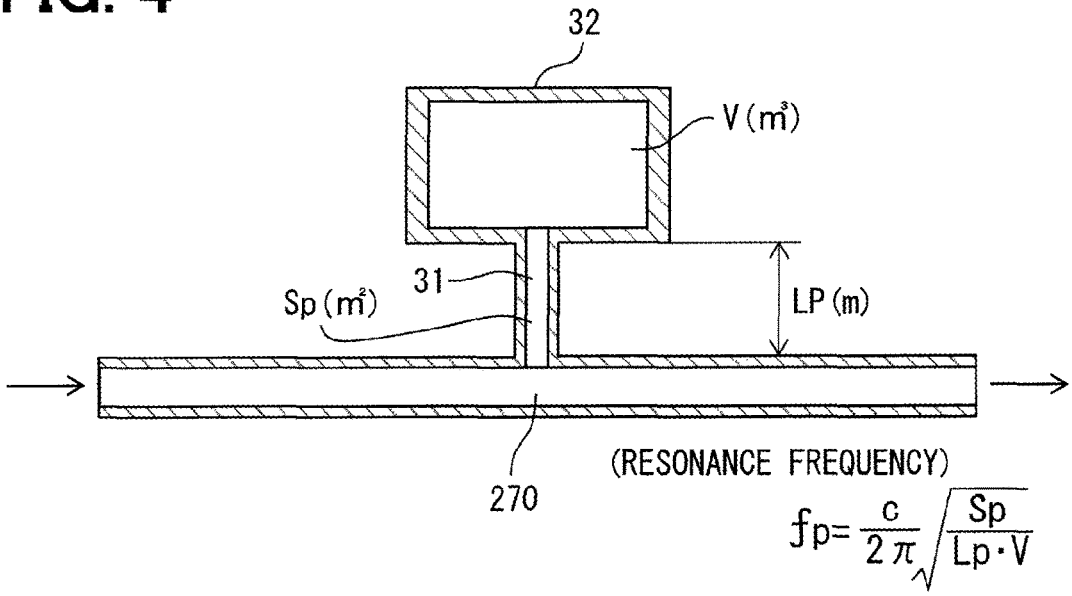
FIG. 4 is a diagram for describing a principle of the resonator of the first embodiment.

Next, the principle of the Helmholtz resonator, which is applied in the resonator 30, will be described. FIG. 4 is a schematic cross-sectional view of the resonator 30 for describing this principle.

In a container shown in FIG. 4, when a portion of the gas refrigerant, which flows in the communication passage 270, enters the inlet passage 31 (having a cross-sectional area Sp ($m^2$), the fluid, which is present in the inlet passage 31 (a neck portion), is pushed upward to compress the fluid having a volume V ($m^3$) in the resonance chamber 32. The compressed fluid tends to return to its original state and thereby push the fluid in the inlet passage 31. When this process is repeated, the fluid in the inlet passage 31 is vibrated. That is, the fluid having the volume V functions as a spring to vibrate the fluid in the inlet passage 31. With this vibration effect, the sound, which has a specific resonance frequency, is generated. This vibration is known as the Helmholtz resonance, and the specific resonance frequency fp of this vibration is obtained with the following equation.

$$fp=(c/2\pi)(Sp/(Lp\cdot V))^{1/2}$$

In the above equation, c (m/s) is a velocity of sound in the refrigerant, and Lp (m) is a length of the inlet passage 31.

In the compressor 1, the refrigerant gas, which flows in the communication passage 270, is supplied to the resonance chamber 32 through the inlet passage 31, so that the pulsating sound, which has the frequency that is the same as or close to the resonance frequency of the resonance chamber 32 (the frequency computed with the above equation), is damped.

The operation of the compressor 1 having the above structure and the flow of the lubricating oil will be described. When an electric power of an external electric power source is supplied to the stator 12 through the inverter 2, the shaft 10 is rotated in response to rotation of the rotor 11. In the compressor 1, when the shaft 10 is driven, the orbiting scroll 18 revolves to create a flow of the refrigerant, which is supplied from the suction port 14, to the motor chamber 15. Furthermore, in the compressor 1, the refrigerant, which is reached to the motor chamber 15, is compressed in the compression chamber 20 of the compression mechanism 4.

When the pressure of the refrigerant, which is compressed in the compression chamber 20, reaches a predetermined discharge pressure, the refrigerant is discharged from the discharge port 21 to the discharge chamber 23. Furthermore, the refrigerant flows from the discharge chamber 23 into the separating chamber 271 through the inlet passage 24 of the oil separator 25. At this time, the refrigerant flows downward while swirling between the separating pipe 26 and the cylindrical wall surface 271*a*, and the refrigerant gas having a low relative density enters the passage in the inside of the separating pipe 26 and is discharged from the discharge port 27 through the communication passage 270 to the external circuit.

In contrast, the lubricating oil, which is contained in the refrigerant and has a high relative density, is blown to the cylindrical wall surface 271*a* of the separating chamber 271 by the centrifugal force and is separated, and the separated lubricating oil falls downward by the gravitational force. The fallen lubricating oil is conducted through the outlet passage 28 and the stationary scroll internal passage 190 due to a pressure difference between the separating chamber 271 and the motor chamber 15, so that the fallen lubricating oil flows through the third housing 29 and the stationary scroll 19. Furthermore, the lubricating oil is accumulated at a boundary surface between the orbiting scroll 18 and the frame 16 and a boundary surface between the orbiting scroll 18 and the stationary scroll 19. The lubricating oil flows the above lubricating oil supply path, so that the lubricating oil lubricates the compression mechanism 4 and the motor unit 3.

The lubricating oil is separated from the refrigerant gas, which flows through the communication passage 270, at the oil separator 25, and a portion of this refrigerant gas flows into the resonance chamber 32 through the inlet passage 31. At this time, the sound, which has the above-described resonance frequency, is generated by the vibration that is referred to as the Helmholtz resonation described above. This sound damps the pulsating sound that has the frequency, which is the same as or close to the resonance frequency.

Next, with reference to FIG. 5, there will be described a result of a verification test that is performed to verify the damping effect of the pulsating sound using an actual device for a compressor (a resonator B shown in FIG. 5), which is equivalent to the compressor of the first embodiment having the resonator 30, and a compressor (a resonator A shown in FIG. 5) of a comparative example.

Figure 5:
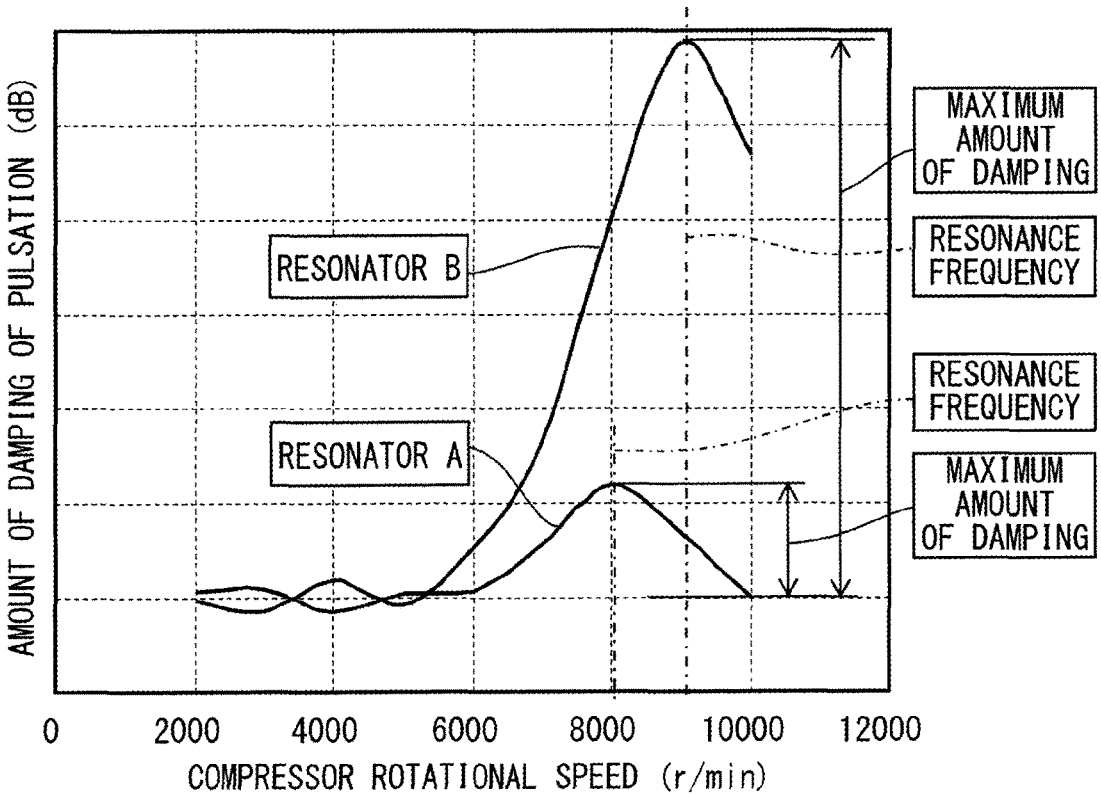
FIG. 5 is a diagram for describing a pulsation damping effect in the compressor of the first embodiment.

FIG. 5 is a graph for describing the pulsation damping effect in the compressor having the resonator A and the compressor having the resonator B, and in FIG. 5, an axis of abscissas is a rotational speed (rpm) of the compressor, and an axis of ordinates is the amount of damping of the pulsation (dB). The rotational speed of the compressor corresponds to the number of vibrations (a frequency) of the sound. For example, in a case of a rotary compressor, which discharges the refrigerant once per rotation, the rotational speed of 6000 (rpm) corresponds to 100 (Hz).

The resonator A indicates the result, which is confirmed with the actual device that is prepared by placing the resonator at a location, which is around the discharge chamber immediately after the compression with the compression mechanism. The resonator A includes a case where the resonator is placed on the upstream side of the oil separator of the first embodiment. The resonator B indicates a result, which is confirmed with the actual device that is prepared by placing the resonator at a location that is similar to the location of the resonator of the first embodiment.

The amount of damping of the pulsation (dB) indicates an effect of damping the pulsating sound in comparison to a compressor that does not have the resonator. As indicated in FIG. 5, it is understood that the amount of damping of the pulsation (dB) at the rotational speed of 9000 (rpm) in the case of the resonator B is about six times larger than the amount of damping of the pulsation at the rotational speed of 8000 (rpm) in the case of the resonator A. Furthermore, the resonance frequency in the case of the resonator B shows a result (corresponding to about 9000 (rpm)) that generally coincides with "a designed resonance frequency", which is obtained with the above equation. In contrast, the resonance frequency in the case of the resonator A shows a result (corresponding to about 8000 (rpm)) that is deviated from "the designed resonance frequency."

Therefore, in the case of the resonator B, it is possible to limit the deviation between the designed resonance frequency and the actual resonance frequency. However, in the case of the resonator A, this deviation cannot be limited. According to these results, in the compressor 1 having the resonator B, it is possible to generate the sound having the target resonance frequency or the frequency close to the target resonance frequency, and thereby the damping function of the resonator can be maximized.

Hereinafter, the effects and advantages of the compressor 1 of the first embodiment will be described. The compressor 1 includes: the discharge chamber 23, which is formed in the inside of the housing 100 and to which the refrigerant immediately after compression by the compression mechanism 4 is discharged; the communication passage 270, which communicates between the discharge chamber 23 and the discharge port 27; and the resonator 30, which is connected to the connecting portion (the intermediate portion) 270*a* of the communication passage 270. The resonator 30 includes: the resonance chamber 32, which is communicated with the connecting portion 270*a* of the communication passage 270; and the inlet passage 31, which has the one end portion 31*c* connected to the connecting portion 270*a* of the communication passage 270 and the other end portion 31*d* connected to the resonance chamber 32.

With this construction, the refrigerant, which is outputted from the discharge chamber 23 immediately after the compression thereof and flows in the communication passage 270, receives the centrifugal force and collides against the wall, so that a larger amount of the lubricating oil is separated from this refrigerant in comparison to the refrigerant that is just discharged into the discharge chamber 23. Thereby, the refrigerant, which flows in the communication passage 270 located on the downstream side of the discharge chamber 23, has an increased ratio of gas in the refrigerant. In the compressor 1, the resonance chamber 32 is communicated to the connecting portion 270*a* of the communication passage 270, which communicates between the discharge chamber 23 and the discharge port 27, through the inlet passage 31, so that introduction of the lubricating oil to the inlet passage 31 or the resonance chamber 32 is limited.

With the compressor 1 described above, it is possible to limit occurrence of hindering of flow of the gas, which is otherwise caused by reduction of the cross-sectional area of the inlet passage 31 by the lubricating oil introduced into the inlet passage 31. Furthermore, it is possible to limit inflow of the lubricating oil, which is contained in the refrigerant, into the resonance chamber 32 through the inlet passage 31. In this way, it is possible to limit reduction of the cross-sectional area Sp ($m^2$) of the inlet passage 31 for passing the gas and reduction of the volume ($m^3$) occupied by the gas in the resonance chamber 32.

As discussed above, in the compressor 1, the resonator 30 can generate the sound that has the target resonance frequency or the frequency that is close to the target resonance frequency. In the compressor 1, the deviation between the designed resonance frequency and the actual resonance frequency is limited, so that the maximum effect of the resonator can be implemented. Therefore, the compressor 1 can effectively limit the pulsating sound.

Furthermore, the connecting portion 270*a* of the communication passage 270, to which the resonator 30 is connected, is located on the downstream side of the oil separator 25 (the oil separating means) in the flow direction of the refrigerant. With this construction, the resonance chamber 32 is communicated with the passage portion, which is located on the downstream side of the oil separator 25, through the inlet passage 31, so that the refrigerant gas, from which the lubricating oil is separated, can flow into the inlet passage 31 and the resonance chamber 32.

With the compressor 1 described above, it is possible to further reliably limit occurrence of hindering of flow of the gas, which is otherwise caused by the reduction of the cross-sectional area of the inlet passage 31 by the lubricating oil introduced into the inlet passage 31. Furthermore, since the lubricating oil, which is contained in the refrigerant, is removed by the oil separator 25, the risk of flowing the lubricating oil into the resonance chamber 32 through the inlet passage 31 is very low. In this way, it is possible to reliably limit the reduction of the cross-sectional area Sp ($m^2$) of the inlet passage 31 for passing the gas and the reduction of the volume ($m^3$) occupied by the gas in the resonance chamber 32.

Furthermore, the other end portion 31*d* of the inlet passage 31 is placed at the location that is higher than the one end portion 31*c* of the inlet passage 31 in the vertical direction. With this construction, even when the lubricating oil is introduced into the inlet passage 31, the lubricating oil can easily flow from the resonance chamber 32 side to the communication passage 270 side in the inlet passage 31 due to the gravitational force. Thereby, the occurrence of hindering of the flow of the gas, which is caused by the reduction of the cross-sectional area of the inlet passage 31 with the lubricating oil, can be quickly eliminated. Thus, in the compressor 1, the sound, which has the resonance frequency obtained with the above equation, can be generated by the resonator 30, so that it can contribute to limit the deviation between the designed resonance frequency and the actual resonance frequency.

Furthermore, in the resonance chamber 32, the bottom surface 320, which is located at the lower side in the vertical direction, is formed such that the bottom surface 320 is lowered toward the other end portion 31*d* of the inlet passage 31. With this construction, even when the lubricating oil is introduced into the resonance chamber 32, the lubricating oil can easily flow toward the inlet passage 31 side due to the gravitational force. Thereby, occurrence of reduction of the volume of the resonance chamber 32, which is occupied by the gas, with the lubricating oil can be quickly eliminated. Thus, in the compressor 1, the sound, which has the resonance frequency obtained with the above equation, can be generated by the resonator 30, so that it can contribute to limit the deviation between the designed resonance frequency and the actual resonance frequency.

Furthermore, the compression mechanism 4 includes the stationary scroll 19, which is fixed to the housing 100 and has the stationary wrap 19*a*, and the orbiting scroll 18, which has the movable wrap 18*a* that is meshed with the stationary wrap 19*a* to form the compression chamber 20. With this construction, it is possible to reduce the size of the compressor of the scroll type having the resonator 30.

Second Embodiment

Figure 6:
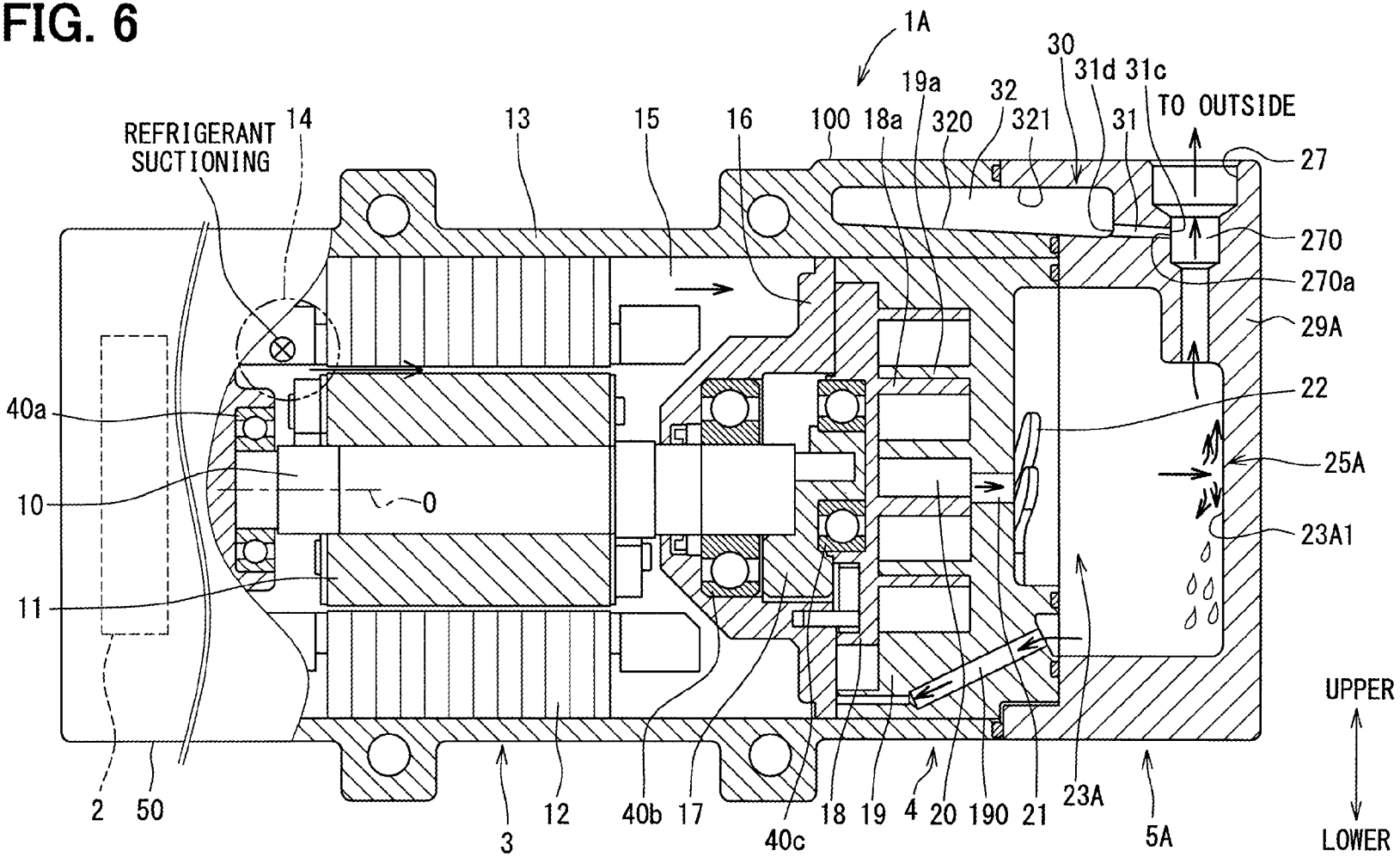
FIG. 6 is a cross-sectional view showing an internal structure of a compressor of a second embodiment.

A compressor 1A of a second embodiment is a modification of the compressor 1 of the first embodiment, as indicated in FIG. 6. The compressor 1A differs from the compressor 1 of the first embodiment with respect to that the compressor 1A includes an oil separator of an impact type (an oil separating means of an impact type) as the oil separator (the oil separating means). In the following description, only the differences, which differ from the first embodiment, will be described. The structure(s), the operation(s), the effect(s), and the advantage(s), which are not described in the second embodiment, are the same as those described in the first embodiment.

The oil separator 25A of the impact type provided in the compressor 1A is the separating means for separating the lubricating oil contained in the refrigerant by colliding the refrigerant, which is compressed by the compression mechanism 4, against a wall surface 23A1.

The oil separator 25A is an oil separator of an impact separation type where the refrigerant, which is compressed in the compression chamber 20, is discharged to the discharge chamber 23A and thereafter collides against the wall surface 23A1 of the discharge chamber 23A (specifically, the wall surface 23A1 of the oil separator 25A), so that the lubricating oil is dropped downward.

The refrigerant, which is compressed by the compression mechanism 4, collides against the wall surface 23A1 of the discharge chamber 23A. At this time, the lubricating oil, which is contained in the refrigerant, is separated from the refrigerant gas and falls downward along the wall surface 23A1, so that the separated lubricating oil flows into the stationary scroll internal passage 190 through the opening, which is formed in the bottom surface portion of the separating chamber 271, and reaches the slidable portion of the orbiting scroll 18. Furthermore, the refrigerant gas, from which the lubricating oil is separated by the oil separator 25A, flows upward along the wall surface 23A1 and is discharged from the discharge port 27 to the outside of the compressor 1A as high pressure refrigerant through the communication passage 270.

The resonator 30 is connected to the connecting portion 270*a* of the communication passage 270, which communicates between the discharge chamber 23A and the discharge port 27. The communication passage 270 is defined as a passage that communicates between the discharge chamber 23A and the discharge port 27. Therefore, the resonator 30 is connected to the connecting portion 270*a* of the communication passage 270, which is located on the downstream side of the oil separator 25A in the flow direction of the refrigerant.

The resonance chamber 32 is a chamber that is formed by combining the first housing 13 with a third housing 29A. The inlet passage 31 is a passage that is formed in an inside of the third housing 29A.

The resonance chamber 32 extends over the stationary scroll 19 and the orbiting scroll 18 of the compression mechanism 4 and the discharge chamber 23A at a location that is on the outer side (a lateral side or an upper side) of the stationary scroll 19 and the orbiting scroll 18 of the compression mechanism 4 and the discharge chamber 23A. The inlet passage 31 is located on the outer side (the lateral side or the upper side) of the discharge chamber 23A. In other words, the resonance chamber 32, the inlet passage 31, or the resonator 30 is placed on the outer side of the oil separator 25A or is placed at a position that is higher than the oil separator 25A and is lower than the discharge port 27.

Third Embodiment

Figure 7:
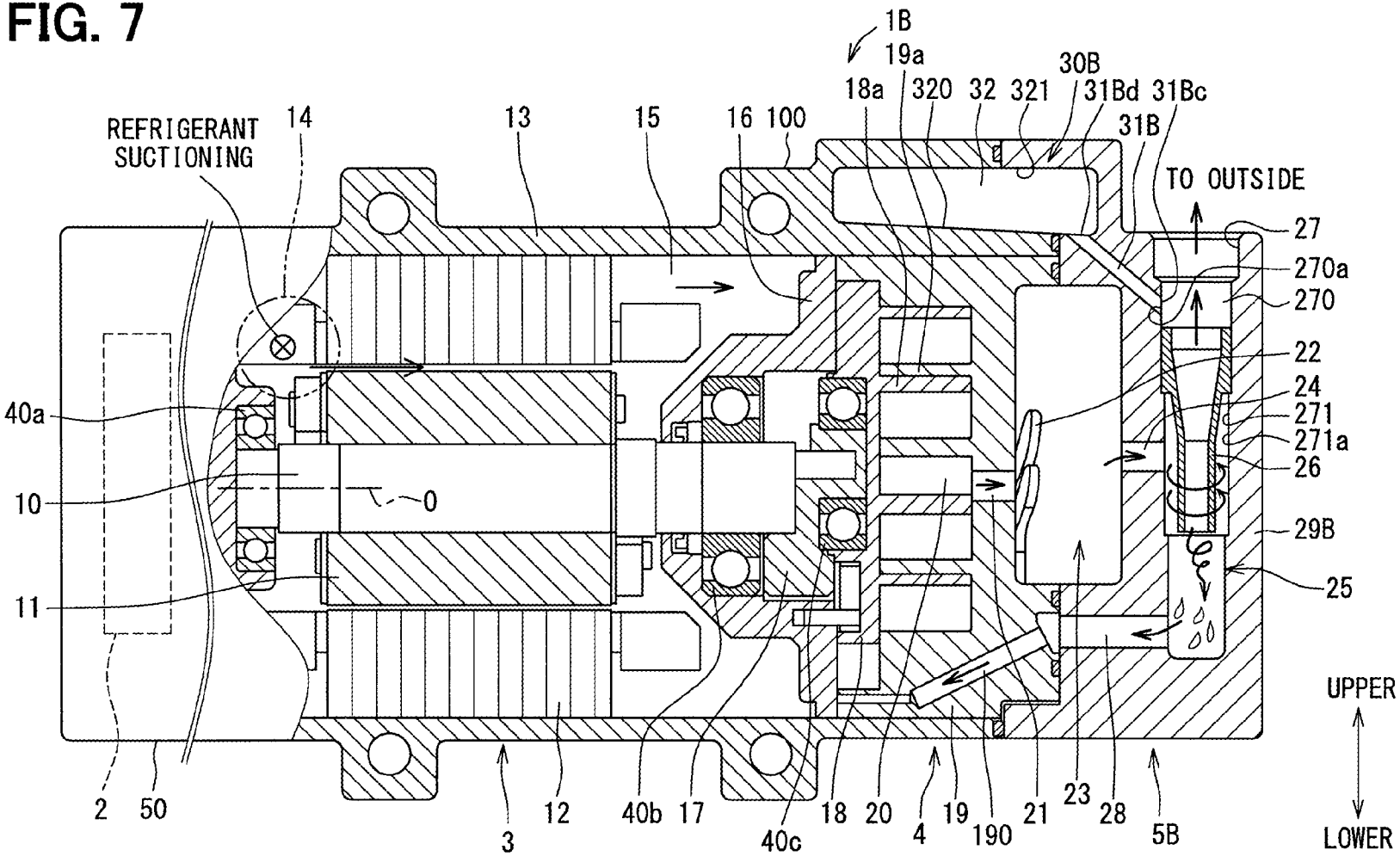
FIG. 7 is a cross-sectional view showing an internal structure of a compressor of a third embodiment.

A compressor 1B of a third embodiment is a modification of the compressor 1 of the first embodiment, as indicated in FIG. 7. The compressor 1B differs from the compressor 1 of the first embodiment with respect to that a resonator 30B is placed at a location, which is the same height as that of the discharge port 27 or is higher than that of the discharge port 27. In other words, the resonator 30B is placed at a location, which is the same as a location of the discharge port 27 in the radial direction of the shaft 10, or a location, which is radially outward of the discharge port 27 in the radial direction of the shaft 10. In the following description, only the differences, which differ from the first embodiment, will be described. The structure(s), the operation(s), the effect(s), and the advantage(s), which are not described in the third embodiment, are the same as those described in the first embodiment.

The resonator 30B is connected to the connecting portion 270*a* of the communication passage 270, which communicates between the discharge chamber 23 and the discharge port 27. The resonator 30B is connected to the connecting portion 270*a* of the communication passage 270, which is located on a downstream side of the oil separator 25.

The resonator 30B includes the resonance chamber 32 and the inlet passage 31. One end portion 31Bc of the inlet passage 31 is connected to the connecting portion 270*a* of the communication passage 270, and the other end portion 31Bd of the inlet passage 31 is connected to the resonance chamber 32. The oil separating portion 5 and an inlet passage 31B are formed in the inside of the third housing 29B.

The resonance chamber 32 is configured such that a cross-sectional area of the resonance chamber 32 is larger than the cross-sectional area of the inlet passage 31B, and a volume of the resonance chamber 32 is larger than a volume of the inlet passage 31B. The resonance chamber 32 of the resonator 30B is placed at a location, which is the same height as that of the discharge port 27 or is higher than that of the discharge port 27. The resonance chamber 32 is tapered in a direction (the left side in FIG. 7) away from the other end portion 31Bd of the inlet passage 31B. A portion of the refrigerant gas, which flows to the discharge port 27 through the communication passage 270, is filled in the resonance chamber 32 through the inlet passage 31.

The inlet passage 31B is connected to the communication passage 270 such that an axis of the inlet passage 31B crosses an axis of the communication passage 270. The inlet passage 31B is formed such that the resonance chamber 32 side of the inlet passage 31B is placed above the communication passage 270 side of the inlet passage 31B. That is, the other end portion 31Bd of the inlet passage 31B, which is connected to the resonance chamber 32, is placed above the one end portion 31Bc of the inlet passage 31B, which is connected to the connecting portion 270*a* of the communication passage 270. A tilt angle of the inlet passage 31B relative to the horizontal direction is set to be larger than a tilt angle of the inlet passage 31 of the first embodiment relative to the horizontal direction. In this way, the fluid, which is supplied into the inlet passage 31B, tends to flow from the resonance chamber 32 side to the communication passage 270 side by the gravitational force and does not tend to stay in the inlet passage 31B. Furthermore, due to the gravitational force, the fluid (e.g., the lubricating oil), which flows into the resonance chamber 32, is outputted from the resonance chamber 32 into the inlet passage 31B and is then outputted into the communication passage 270 after flowing through the inlet passage 31B. The tilt angle of the inlet passage 31B is larger than the tilt angle of the inlet passage 31 of the first embodiment. That is, the angle θ of the axis of the inlet passage 31B relative to the reference line R of FIG. 3, which extends in the horizontal direction, is larger than the angle θ of the axis S of the inlet passage 31 of the first embodiment.

The resonator 30B is formed in the inside of the housing 100 of the compressor 1. Specifically, the resonance chamber 32 is a chamber that is formed by combining the first housing 13 and the third housing 29A. The inlet passage 31B is a passage that is formed in an inside of the third housing 29A.

The resonance chamber 32 of the resonator 30B extends over the stationary scroll 19 and the orbiting scroll 18 of the compression mechanism 4 and the discharge chamber 23 at a location that is on the outer side (a lateral side or an upper side) of the stationary scroll 19 and the orbiting scroll 18 of the compression mechanism 4 and the discharge chamber 23. The resonance chamber 32 side of the inlet passage 31B extends to a height that is generally the same as the height of the discharge port 27. In other words, the other end portion 31Bd of the inlet passage 31B is placed at the height, which is generally the same as the height of the discharge port 27.

Other Embodiments

The preferred embodiments of the present disclosure have been described. However, the present disclosure is not limited to the above embodiments. The above embodiments may be modified in various ways without departing from the scope of the present disclosure.

The structures of the above embodiments are mere examples, and the scope of the present disclosure is not limited to them. The scope of the present disclosure is indicated by the writings of the claims and includes all of modifications within the meaning and the scope that are equivalent to the writings of the claims.

For example, in the above embodiments, the scroll compressor is described as an example of the compressor. However, the compressor of the present disclosure is not limited to the scroll compressor. For example, the compressor can be, for example, a rotary piston compressor, a reciprocating compressor, a slide vane compressor, or a rotary compressor.

In the above embodiments, the resonator 30, 30B is placed in the inside of the housing 100 of the compressor 1. However, the compressor of the present disclosure is not limited to the above structure, and the compressor of the present disclosure may include a case where the resonator is provided separately from the housing 100 of the compressor 1.

In the above embodiments, the axis of the inlet passage 31, 31B is set such that the resonance chamber 32 side of the axis of the inlet passage 31, 31B is placed at the location that is higher than the other side of the axis of the inlet passage 31, 31B to define the predetermined angle relative to the reference line that extends in the horizontal direction. However, the present disclosure is not limited to such a configuration for tilting the axis of the inlet passage 31, 31B in such a uniform manner. The configuration of placing the resonance chamber 32 side of the inlet passage 31, 31B at the location, which is higher than the communication passage 270 side of the inlet passage 31, 31B, includes a configuration of the inlet passage 31, 31B, in which the resonance chamber 32 side of the inlet passage 31, 31B is placed higher than the communication passage 270 side of the inlet passage 31, 31B while the inlet passage 31, 31B is configured into a stepwise form that rises toward the resonance chamber 32 side. Similarly, the bottom surface 320 of the resonance chamber 32 may be formed such that the bottom surface 320 is configured into a stepwise form that declines toward the other end portion 31*d*, 31B of the inlet passage 31, 31B.

Furthermore, the refrigerant, which is drawn into the compressor 1 in the above embodiments, is HFC-134a.

However, another type of refrigerant may be used in place of HFC-134a. For example, refrigerant, which includes CO2 as its major component, may be used.

The invention claimed is:

1. A compressor comprising:

a housing that includes a suction port, into which refrigerant flows from an outside of the housing, and a discharge port, through which the refrigerant is discharged to the outside of the housing after compression of the refrigerant;

a compression mechanism that is formed in an inside of the housing and compresses the refrigerant drawn through the suction port;

a discharge chamber that is formed in the inside of the housing, wherein the refrigerant, which is compressed by the compression mechanism, is discharged into the discharge chamber immediately after compression of the refrigerant by the compression mechanism;

a communication passage that communicates between the discharge chamber and the discharge port; and a resonator that is connected to an intermediate portion of the communication passage; and an oil separator, which is placed on a downstream side of the discharge chamber in a flow direction of the refrigerant and separates lubricant oil from the refrigerant that is compressed by the compression mechanism, wherein:

the intermediate portion of the communication passage is located on a downstream side of the oil separator in the flow direction of the refrigerant; and the resonator includes:

a resonance chamber that is communicated with the intermediate portion of the communication passage; and an inlet passage that has a first end portion, which is connected to the intermediate portion of the communication passage, and a second end portion, which is connected to the resonance chamber.

2. The compressor according to claim 1, where the oil separator is an oil separator that separates the lubricant oil contained in the refrigerant by colliding the refrigerant, which is compressed by the compression mechanism, against a wall surface of the oil separator.

3. The compressor according to claim 1, wherein the oil separator is a centrifugal oil separator that separates the lubricant oil contained in the refrigerant by swirling the refrigerant, which is compressed by the compression mechanism.

4. The compressor according to claim 1, wherein the second end portion of the inlet passage is placed in a location that is higher than the first end portion of the inlet passage in a vertical direction.

5. The compressor according to claim 4, wherein a bottom surface of the resonance chamber, which is located on a lower side in the vertical direction, is angled downward in a vertical direction toward the second end portion of the inlet passage.

6. The compressor according to claim 1, wherein the resonator is placed in the inside of the housing.

7. The compressor according to claim 1, wherein the compression mechanism includes:

a stationary scroll that is fixed to the housing and has a stationary wrap; and a movable scroll that has a movable wrap that is meshed with the stationary wrap to form a compression chamber.

8. The compressor according to claim 1, comprising an electric motor unit that is placed in the inside of the housing, wherein:

the electric motor unit includes a shaft, which is connected to the compression mechanism to drive the compression mechanism; and the second end portion of the inlet passage is further spaced from a rotational axis of the shaft in a radial direction of the shaft in comparison to the first end portion of the inlet passage.

9. The compressor according to claim 8, wherein:

the resonance chamber has a bottom surface, which is located on a side wherein the rotational axis is placed in the radial direction; and a distance between the bottom surface of the resonance chamber and the rotational axis of the shaft decreases toward the second end portion of the inlet passage in an axial direction of the rotational axis.

10. The compressor according to claim 9, wherein:

the resonance chamber has a ceiling surface, which is located on a side that is opposite from the bottom surface in the radial direction; and at an end portion of the resonance chamber, which is adjacent to the second end portion of the inlet passage, a distance between the bottom surface of the resonance chamber and the second end portion of the inlet passage in the radial direction is smaller than a distance between the ceiling surface of the resonance chamber and the second end portion of the inlet passage in the radial direction.

11. The compressor according to claim 1, wherein:

a cross-sectional area of the inlet passage is smaller than a cross-sectional area of the resonance chamber; and the resonance chamber opens only to the inlet passage.

12. The compressor according to claim 1, wherein the resonance chamber is placed on a radially outer side of the compression mechanism.

13. A compressor comprising:

a housing that includes a suction port, into which refrigerant flows from an outside of the housing, and a discharge port, through which the refrigerant is discharged to the outside of the housing after compression of the refrigerant;

a compression mechanism that is formed in an inside of the housing and compresses the refrigerant drawn through the suction port;

a discharge chamber that is formed in the inside of the housing, wherein the refrigerant, which is compressed by the compression mechanism, is discharged into the discharge chamber immediately after compression of the refrigerant by the compression mechanism;

a communication passage that communicates between the discharge chamber and the discharge port;

a resonator that is connected to an intermediate portion of the communication passage; and an electric motor unit that is placed in the inside of the housing, wherein:

the resonator includes:

a resonance chamber that is communicated with the intermediate portion of the communication passage; and an inlet passage that has a first end portion, which is connected to the intermediate portion of the communication passage, and a second end portion, which is connected to the resonance chamber;

the electric motor unit includes a shaft, which is connected to the compression mechanism to drive the compression mechanism;

the second end portion of the inlet passage is further spaced from a rotational axis of the shaft in a radial direction of the shaft in comparison to the first end portion of the inlet passage;

the resonance chamber has a bottom surface, which is located on a side wherein the rotational axis is placed in the radial direction; and a distance between the bottom surface of the resonance chamber and the rotational axis of the shaft decreases toward the second end portion of the inlet passage in an axial direction of the rotational axis.

14. The compressor according to claim 13, wherein:

the resonance chamber has a ceiling surface, which is located on a side that is opposite from the bottom surface in the radial direction; and at an end portion of the resonance chamber, which is adjacent to the second end portion of the inlet passage, a distance between the bottom surface of the resonance chamber and the second end portion of the inlet passage in the radial direction is smaller than a distance between the ceiling surface of the resonance chamber and the second end portion of the inlet passage in the radial direction.

15. The compressor according to claim 13, wherein:

a cross-sectional area of the inlet passage is smaller than a cross-sectional area of the resonance chamber; and the resonance chamber opens only to the inlet passage.

16. The compressor according to claim 13, wherein the resonance chamber is placed on a radially outer side of the compression mechanism.

17. The compressor according to claim 13, wherein the second end portion of the inlet passage is placed in a location that is higher than the first end portion of the inlet passage in a vertical direction.

18. The compressor according to claim 17, wherein the bottom surface of the resonance chamber, which is located on a lower side in the vertical direction, is angled downward toward the second end portion of the inlet passage.

19. The compressor according to claim 13, wherein the resonator is placed in the inside of the housing.

20. The compressor according to claim 13, wherein the compression mechanism includes:

a stationary scroll that is fixed to the housing and has a stationary wrap; and a movable scroll that has a movable wrap that is meshed with the stationary wrap to form a compression chamber.

* * * * *